US011319182B2

(12) United States Patent
Norton et al.

(10) Patent No.: US 11,319,182 B2
(45) Date of Patent: May 3, 2022

(54) SUPPORTS, SYSTEMS, AND METHODS FOR IMPROVED STORAGE OF CABLE REEL PAYOUT DEVICES

(71) Applicant: Southwire Company, LLC, Carrollton, GA (US)

(72) Inventors: Andrew Cody Norton, Carrollton, GA (US); Tyler Barr Stogner, Bowdon, GA (US)

(73) Assignee: Southwire Company, LLC, Carrollton, GA (US)

( * ) Notice: Subject to any disclaimer, the term of this patent is extended or adjusted under 35 U.S.C. 154(b) by 0 days.

(21) Appl. No.: 16/916,772

(22) Filed: Jun. 30, 2020

(65) Prior Publication Data

US 2021/0403275 A1 Dec. 30, 2021

(51) Int. Cl.
*B65H 49/32* (2006.01)
*B65H 49/24* (2006.01)

(52) U.S. Cl.
CPC ..... *B65H 49/328* (2013.01); *B65H 49/24* (2013.01); *B65H 2402/40* (2013.01)

(58) Field of Classification Search
CPC .. B65H 49/24; B65H 49/328; B65H 2402/40; A47B 2087/023
See application file for complete search history.

(56) References Cited

U.S. PATENT DOCUMENTS 1,096,618 A 5/1914 Fussell
3,502,227 A 3/1970 Konstant et al.
3,652,026 A 3/1972 Awebro
3,664,274 A 5/1972 Bustos
4,325,522 A 4/1982 Sauber
4,454,999 A 6/1984 Woodruff
4,488,649 A 12/1984 Mark
4,945,938 A 8/1990 Ponsford et al.
5,113,976 A 5/1992 Noakes
6,042,061 A 3/2000 Shimizu
6,241,108 B1 6/2001 Nakatani et al.
6,435,450 B1 8/2002 Shields et al.
6,533,248 B1 3/2003 Schafer
8,408,520 B2 4/2013 Jordan et al.
8,444,078 B1 5/2013 Brown et al.
9,077,163 B2 7/2015 Hull
9,079,745 B2 7/2015 Galindo Gonzalez et al.
(Continued)

FOREIGN PATENT DOCUMENTS

DE 29513650 U1 * 4/1996 ..... B65H 49/24
GB 763256 A * 12/1956 ..... F16B 12/40
(Continued)

OTHER PUBLICATIONS

Machine Translation of DE 295 13 650 U1, Apr. 25, 1996. (Year: 1996).*

*Primary Examiner* — William E Dondero
(74) *Attorney, Agent, or Firm* — Merchant & Gould P.C.

(57) ABSTRACT

Disclosed herein are stackable cable payout devices and systems for converting cable payout systems to stackable systems. Methods of stacking cable payout devices, such as cable reel rollers are also disclosed herein. Stacking systems disclosed herein may be adjustable, and may accommodate materials commonly available at storage facilities. Devices, systems, and methods disclosed herein allow increased efficiency in storage of cable payout machinery.

20 Claims, 8 Drawing Sheets

(56) References Cited

U.S. PATENT DOCUMENTS

| | | | |
|---|---|---|---|
| 9,452,908 | B1 | 9/2016 | Bigbee, Jr. et al. |
| 9,820,572 | B1 | 11/2017 | Kuehn |
| 9,994,416 | B2 | 6/2018 | Worton |
| 10,277,023 | B2 | 4/2019 | Robertson et al. |
| 2009/0196723 | A1 | 8/2009 | Smith et al. |
| 2014/0070045 | A1 | 3/2014 | Robinson |
| 2018/0093851 | A1 | 4/2018 | Thakare et al. |

FOREIGN PATENT DOCUMENTS

| | | |
|---|---|---|
| WO | WO2011/129604 | 10/2017 |
| WO | WO2017/181224 | 10/2017 |
| WO | WO2018/033122 | 2/2018 |
| WO | WO2019/089747 | 5/2019 |
| WO | WO2019/137761 | 7/2019 |

* cited by examiner

SUPPORTS, SYSTEMS, AND METHODS FOR IMPROVED STORAGE OF CABLE REEL PAYOUT DEVICES

FIELD OF THE INVENTION

The present disclosure generally relates to methods and systems of improving the storage efficiency of cable payout devices, such as cable reel rollers. More specifically, the present disclosure is related to the supports which allow bulky and heavy cable payout devices to be stacked vertically, thereby reducing the storage footprint. Supports, systems, and methods disclosed herein also can be configured to minimize potential for tipping and maximize stability.

BACKGROUND OF THE INVENTION

Large cable reels suited for spooled power cables can weigh several hundred pounds, in addition to the weight of the cable itself. Spooled cables often weigh tens of thousands of pounds, and the substantial weight provides a challenge during paying out the cable from the reels during installation. Cable payout devices have been provided with excellent strength and stability, however, often can be difficult to transport, position and store, due to their weight, size, and operating features.

Cable reel rollers provide a lower profile cable payout device that supports the cable reel on rollers which contact the reel flange and allow the reel to rotate in place when seated on the rollers. Despite the low profile arrangement of cable reel rollers, conventional cable payout systems have not been suited to be stored in a compact manner due to the weight and irregular shape of the rollers. It can also be preferable that the roller mechanism of the cable reel rollers intended to interact with the cable reel flange are configured as the top plane of the cable reel rollers, providing an open face for accepting the cable reels during loading the reels for payout. Positioning of the rollers as the top face of the cable payout device exposes a critical feature of conventional cable reel roller and may result in damage to the rollers where stacked. Stacking such conventional rollers may also result in instability providing a dangerous storage condition prone to shifting and tipping. Given the weight of the conventional cable payout devices, any shifting or tipping of a stack poses significant danger to equipment and staff.

SUMMARY

Stackable supports are disclosed herein to address at least the disadvantages of conventional cable reel rollers described above. Stack supports disclosed herein may comprise a dividing plate separating a first collar and a second collar. Each of the first and second collar may be configured to receive a spacer as disclosed herein. The dividing plate may be configured to withstand the force imposed by the spacer as a result of the weight of the cable payout devices stacked above. First and second collars may serve to withstand any horizontal force applied to a stack of cable payout devices, and resist tipping from a vertical position.

Stackable cable payout devices disclosed herein include cable reel rollers, and can comprise a frame, a plurality of rollers supported by the frame, and a plurality of supports as described above. Stackable systems are also disclosed, and may comprise a support as disclosed above, and a spacer having a cross-section smaller than that of the first and second collar of the support. In this manner the spacer can be inserted within the collar.

BRIEF DESCRIPTION OF THE FIGURES

The foregoing and other objects, features, and advantages of the embodiment and methods disclosed herein will be apparent from the following description of particular embodiments thereof, as illustrated in the accompanying drawings. The drawings are not necessarily to scale, emphasis instead being placed upon illustrating the principles of the embodiments and methods disclosed herein.

DETAILED DESCRIPTION OF THE INVENTION

Figure 1:
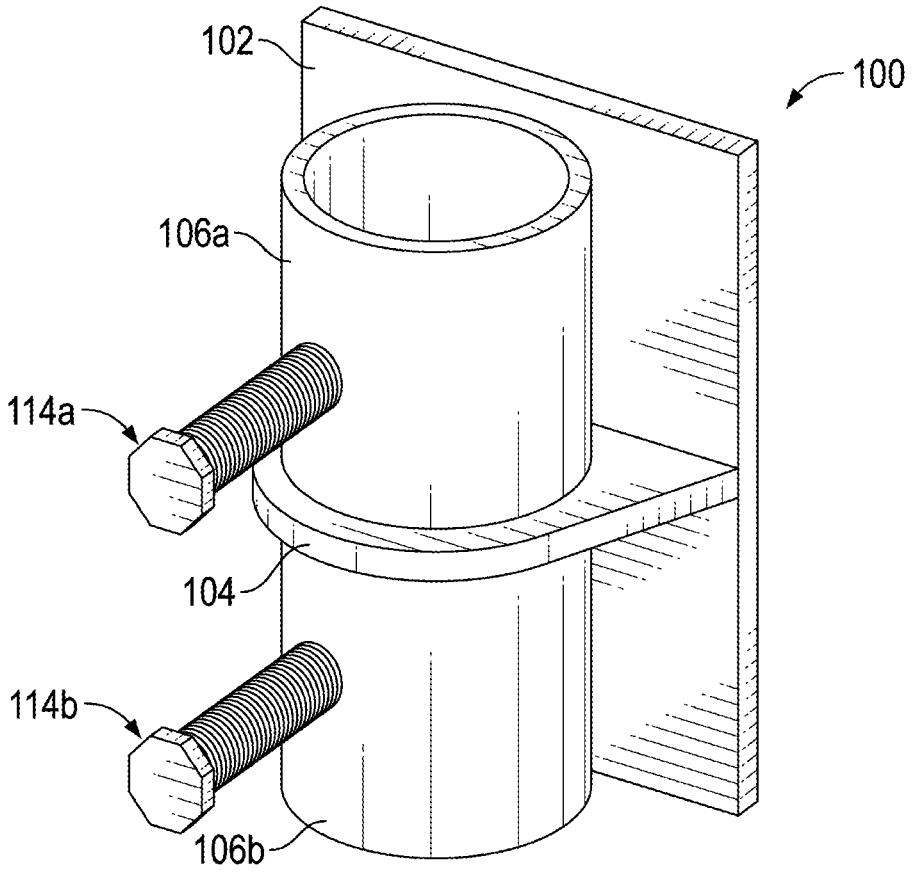
FIG. 1 depicts an embodiment of a support comprising an adjustable mechanism associated with each collar.

The information that follows describes embodiments with reference to the accompanying figures, in which preferred embodiments are shown. The foregoing may, however, be embodied in many different forms and should not be construed as limited to the illustrated embodiments set forth herein.

The phrase "a" or "an" entity as used herein refers to one or more of that entity.

References to items in the singular should be understood to include items in the plural, and vice versa, unless explicitly stated otherwise or clear from the context. Grammatical conjunctions are intended to express any and all disjunctive and conjunctive combinations of conjoined clauses, sentences, words, and the like, unless otherwise stated or clear from the context. Thus, unless otherwise indicated or made clear from the context, the term "or" should generally be understood to mean "and/or" and, similarly, the term "and" should generally be understood to mean "and/or."

Recitation of ranges of values herein are not intended to be limiting, referring instead individually to any and all values falling within the range, unless otherwise indicated herein, and each separate value within such a range is incorporated into the specification as if it were individually recited herein.

The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described embodiments. The use of any and all examples, or exemplary language ("e.g.,"

"such as," or the like) provided herein, is intended merely to better illuminate the embodiments and does not pose a limitation on the scope of the embodiments or the claims. No language in the specification should be construed as indicating any unclaimed element as essential to the practice of the embodiments.

In the following description, it is understood that terms such as "first," "second," "third," "upper," "lower," "below," and the like, are words of convenience and are not to be construed as implying a positional or chronological order or otherwise limiting any corresponding element unless expressly stated otherwise.

The term "diameter" as used herein is not limited to circular shapes, and describes a dimension of the shape that crosses from one surface and through the center of the shape to another surface of a given cross-section of an element. Thus, as used herein, the term "diameter" may be applied to circular cross-sections, and also to cross-section of other regular and irregular shapes, such as square-shaped, rectangular, and oval-shaped cross-sections. As a non-limiting example, a 1 inch square-shaped tubing can have a diameter represented by the diagonal length from corner to corner and passing through the center of the square, or approximately 1.4 inches. The same square shaped tubing may also have diameters ranging from the width of the square (1 inch) to the diagonal diameter.

It will be understood that the expression "comprising" may be replaced with the expression "consisting of" for the embodiments disclosed herein.

The definitions and/or meanings of subject matter described herein controls in the event that incorporated subject matter conflicts with subject matter described herein.

The information that follows details various embodiments of the disclosure. For the avoidance of doubt, it is specifically intended that any particular feature(s) described individually in any one of these paragraphs (or part thereof) may be combined with one or more other features described in one or more of the remaining paragraphs (or part thereof). In other words, it is explicitly intended that the features described below individually in each paragraph (or part thereof) represent aspects of the disclosure that may be taken in isolation and/or combined with other aspects of the disclosure. The skilled person will appreciate that the claimed subject matter extends to such combinations of features and that these have not been recited in detail here in the interest of brevity.

Disclosed herein are stackable reel rollers comprising a frame, a plurality of rollers supported by the frame, and a support comprising a dividing plate secured to the frame, a first collar attached to a first side of the dividing plate, and a second collar attached to a second side of the dividing plate. Stackable reel rollers described herein may have a plurality of supports. The first and second collars can be configured to receive a spacer, as described herein. Stackable reel roller systems are also disclosed herein as comprising any stackable reel roller disclosed herein and further comprising a spacer configured to seat within the first or second collar. Methods for stacking a plurality of cable reel rollers are also contemplated herein, and can comprise inserting a first portion of a spacer within a support of any stackable cable reel roller described herein, and coupling a second portion of the spacer within a support of a second stackable cable reel roller.

Figure 8:
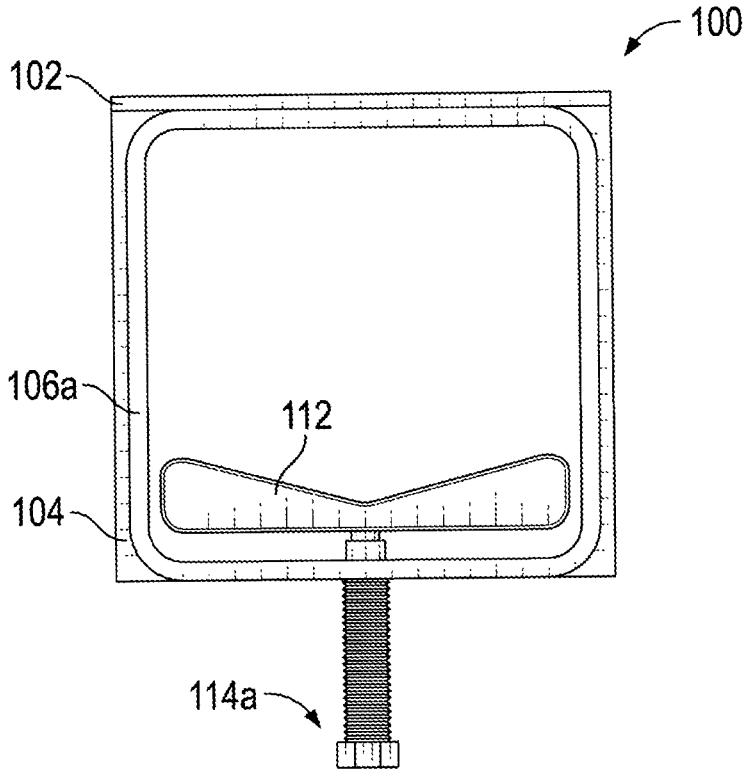
FIG. 8 depicts a top view of the support shown in FIG. 4, which is a mirror image of the bottom view.
Figure 9:
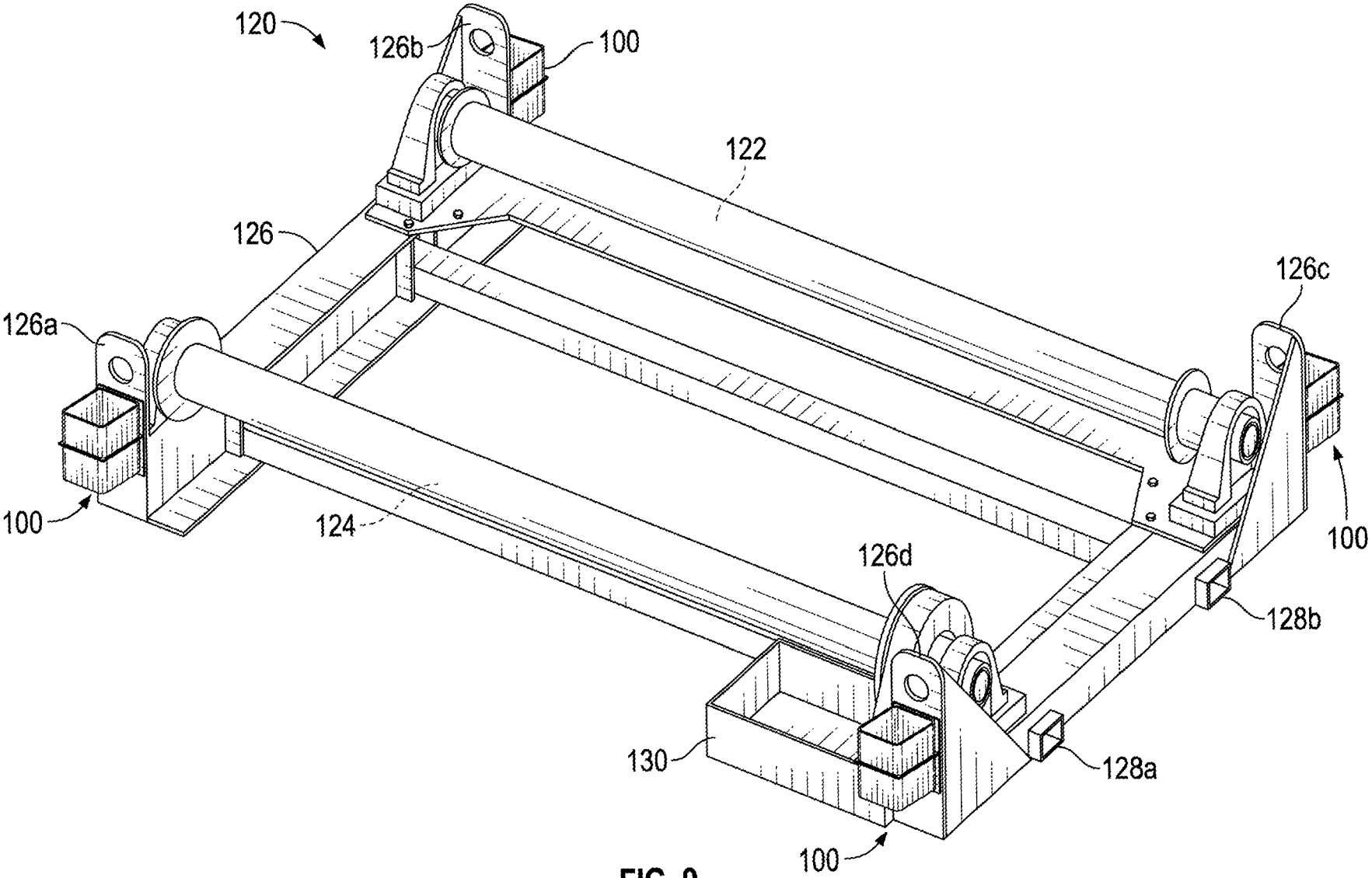
FIG. 9 depicts an embodiment of a stackable reel roller comprising a support as shown in FIG. 4 secured to each of the four corners of the cable reel roller frame.

FIG. 1 represents an exemplary support which allows cable reel rollers to be stacked. As shown, the support comprises back plate 102, dividing plate 104, and collars 106*a,b*. Each of collars 106*a,b* further comprises an adjustment mechanism that comprises an adjustment saddle (as shown in FIG. 8) secured to adjustment bolt 114. The adjustment saddle can be retained on the bolt in a loose configuration such that bolt 114 may be rotated to induce lateral motion of the adjustment saddle across the interior of the collar, but without inducing rotation of the adjustment saddle. The adjustment saddle may be any shape suitable to secure the spacer within the collar, and thus may be crescent-shaped in certain embodiments so as to seat against the outer surface of a cylindrical spacer having a width or diameter in a range from about 1.5 inches to about 4 inches. The dividing plate, back plate, and collars, may be constructed of any material suitable to support the weight of the stacked rollers and retain the spacers within the collars. FIGS. 5-8 depict views of a support as shown in FIG. 1.

Figure 2:
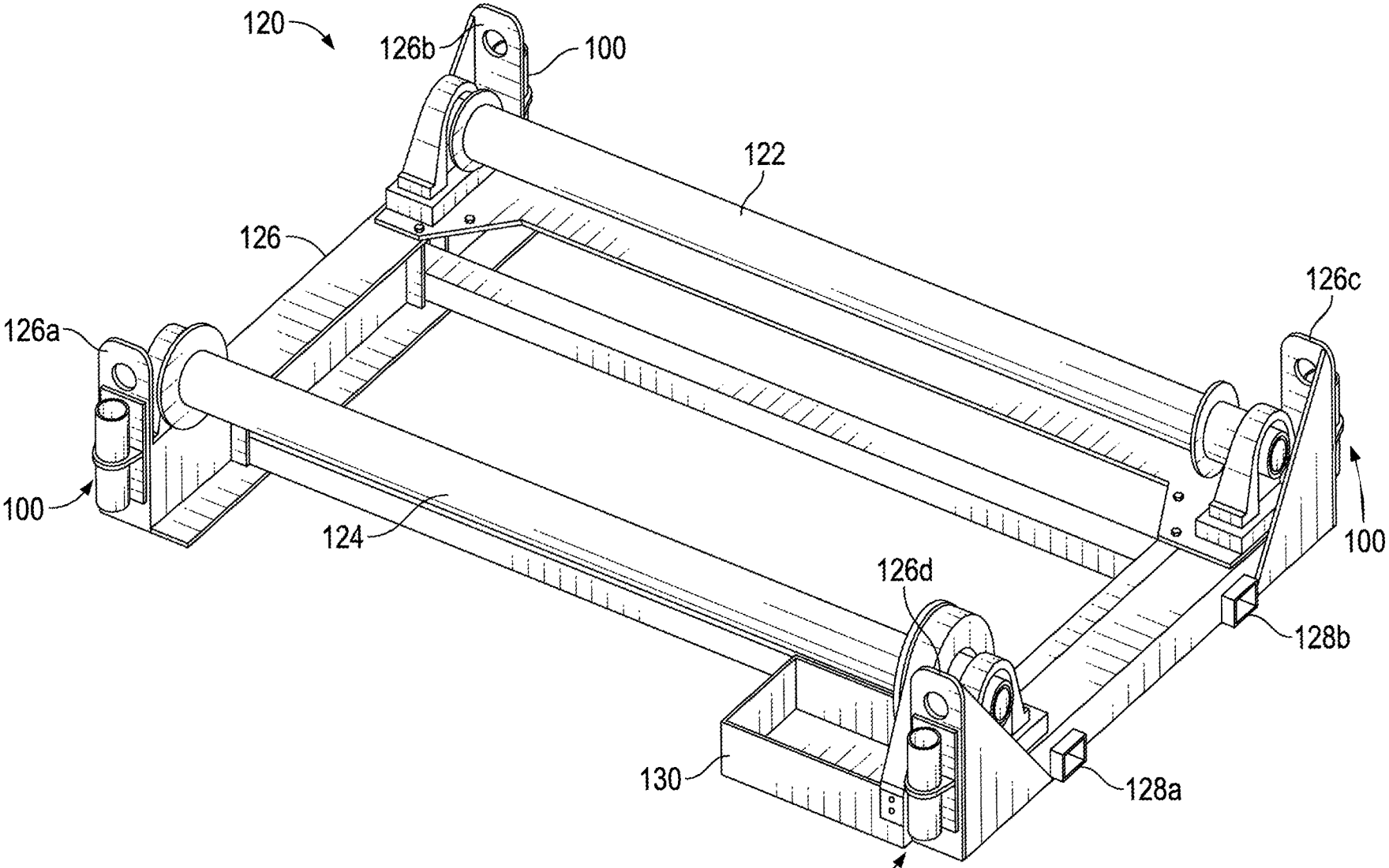
FIG. 2 depicts a stackable cable reel roller comprising a support secured to each of the four corners of the cable reel roller frame.

FIG. 2 represents an embodiment of a cable payout device disclosed herein, comprising supports 100 secured to each of four corners of frame 126, at attachment faces 126*a,b,c,d*. Supports 100 are provided in a vertical orientation, and welded to frame of cable payout device 120. As noted herein, in certain aspects, attachment faces 126*a,b,c,d* may serve as the back plate of the support, allowing dividing plate 104 and collars 106*a,b* to be secured directly to the frame of the cable payout device. Cable payout device 120 further comprises a pair of cable reel rollers including auxiliary roller 122 provided for support of a cable reel and powered roller 124 to aid in advancing a cable reel along its flange during cable payout. Powered roller 124 can be electrically connected to a motor supported by motor tray 130. Frame 126 also can comprise fork receiving channels 128*a,b* for the insertion of forks of a forklift during transport, stacking, and unstacking, as described below.

Figure 3:
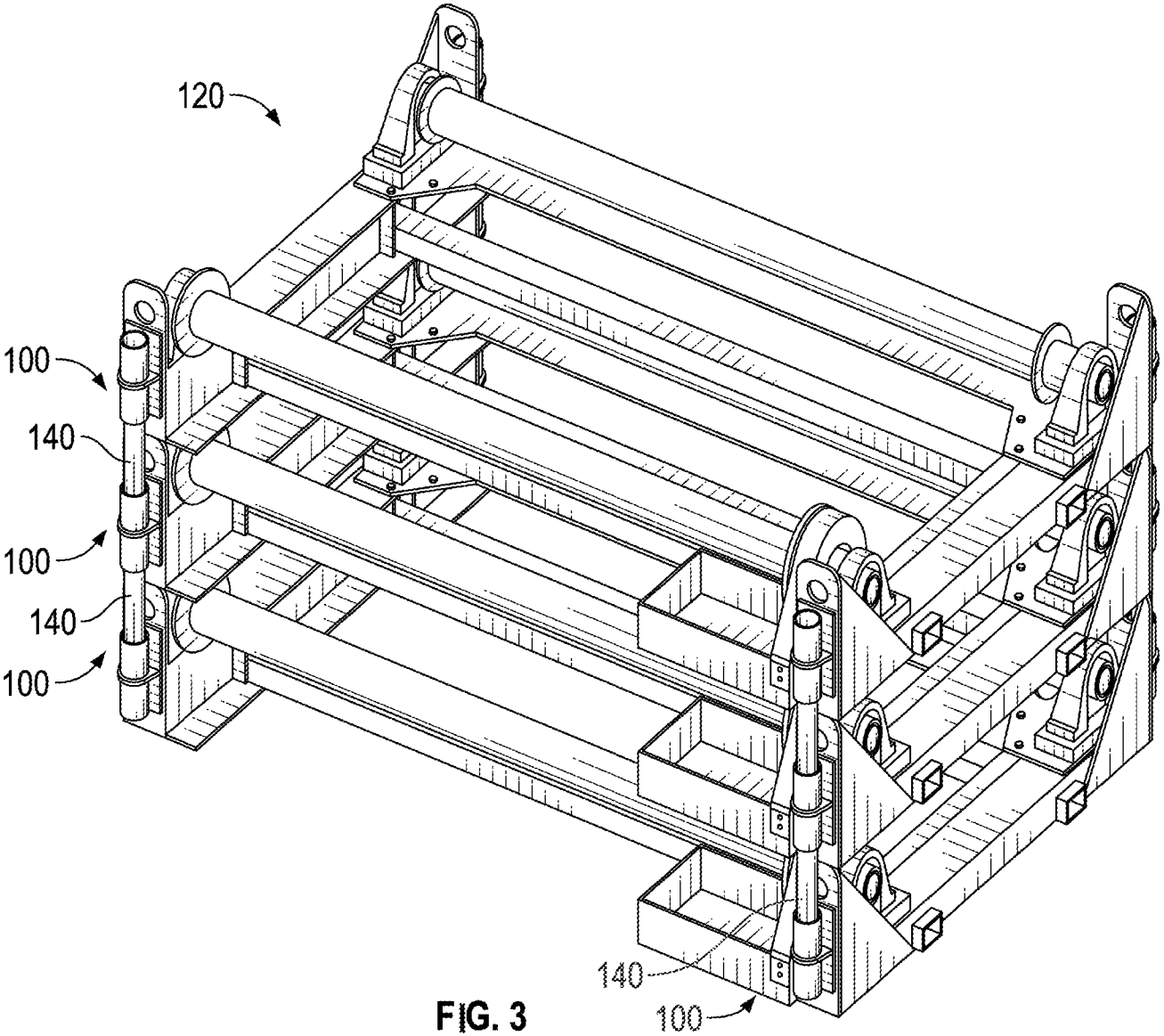
FIG. 3 depicts a series of stacked cable reel rollers representing the stackable cable reel roller system, coupling a spacer in between each of the supports.
Figure 4:
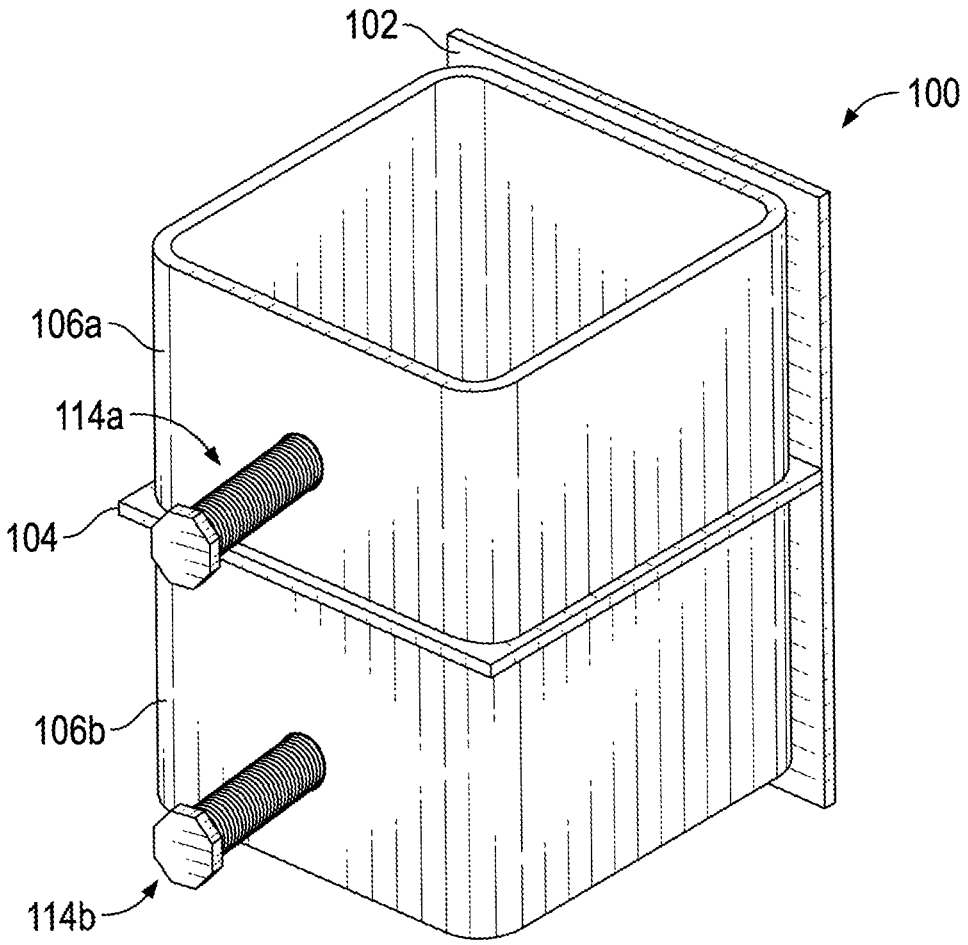
FIG. 4 depicts a perspective view of another embodiment of a support.
Figure 5:
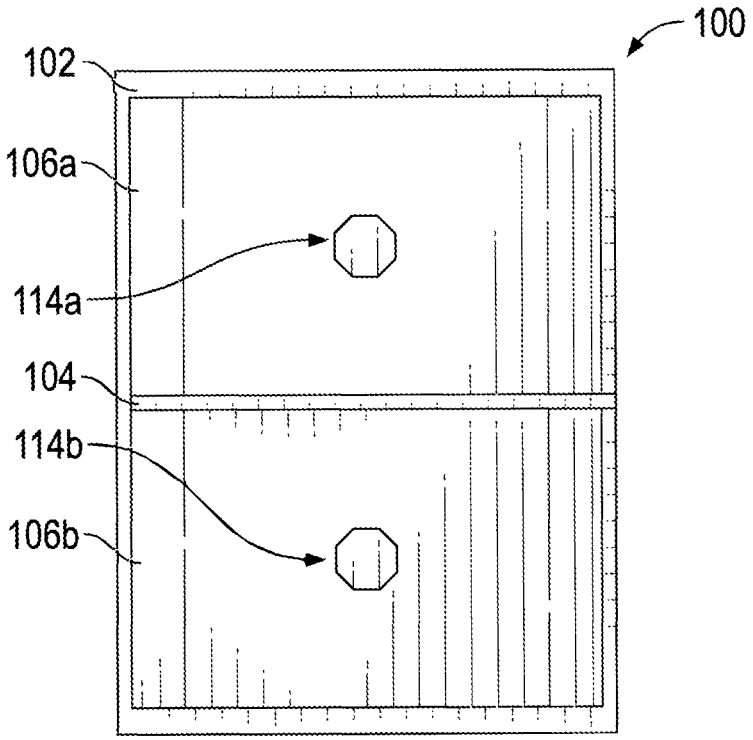
FIG. 5 depicts a front view of the support shown in FIG. 4.
Figure 6:
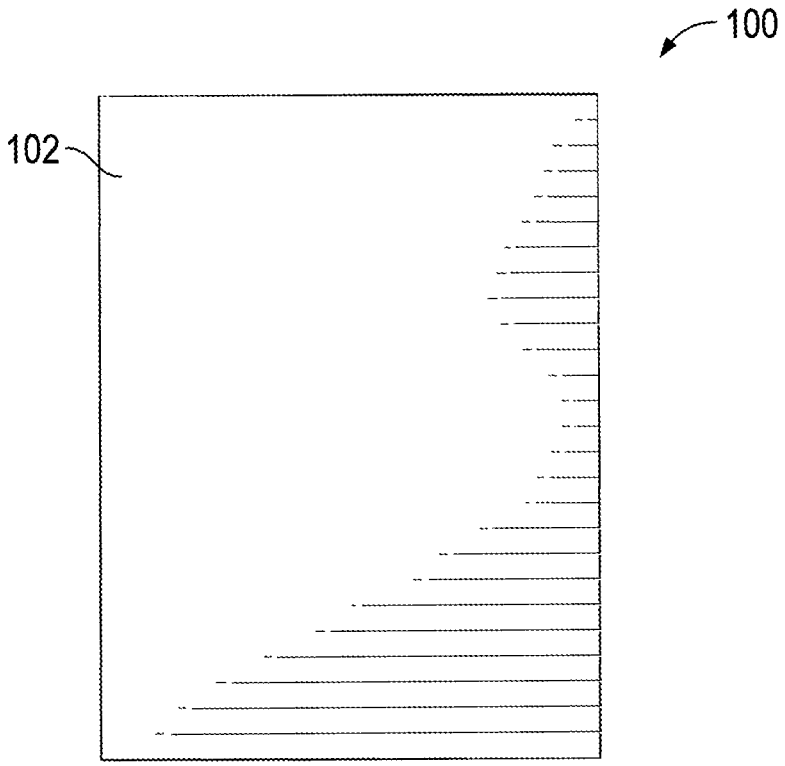
FIG. 6 depicts a back view of the support shown in FIG. 4.
Figure 7:
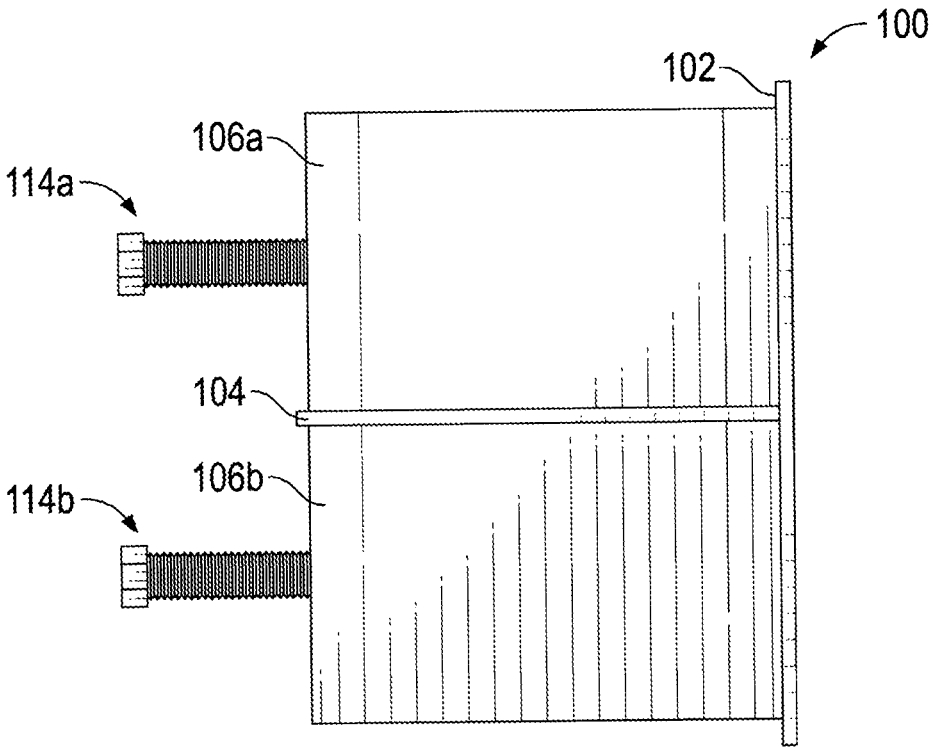
FIG. 7 depicts a left side view of the support shown in FIG. 4, which is a mirror image of the right side view.

FIG. 3 further shows the stacking of cable payout devices depicted in FIG. 2 by the use of spacers 140 between aligned collars of each support on each of the cable reel rollers depicted. In the stacked arrangement, it can be seen that the dividing plates of supports on the bottom cable reel roller can accommodate a share of the combined weight of each stacked reel roller. Thus, the dividing plate can be constructed of material capable to withstand these stacking forces. In certain aspects, the dividing plate can be a steel plate having a suitable thickness to support the weight of the stacked reel rollers. In certain aspects, the dividing plate can have a width of ⅛ inch, ¼ inch, or ½ inch. In certain aspects, the dividing plate, first and second collars, and back plate can comprise ¼ inch steel. Alternative materials capable of withstanding the pressure applied by the spacers are also contemplated herein.

As shown in each of FIGS. 1-3, collars 106*a,b* can be cylindrical and attached to both dividing plate 104 and back plate 102. In certain aspects, an independent back plate 102 may be excluded from the support, instead relying on a substantially vertical portion of the cable reel roller frame as a back plate providing a fixed position for the dividing plate and collars. Dividing plate 104 is also shown as providing a division between collar 106*a* and collar 106*b*, encompassing a cross-sectional area of each collar. The shape and form of the dividing plate are not limited to any particular design, so long as the spacer is adequately supported when provided within the collar, and such that the dividing plate may support the combined weight of cable payout devices stacked upon the spacers. Dividing plates may generally can be any that serve to secure and retain the position of collars with respect to the cable reel roller frame. In certain aspects, the dividing plate may be circular, rectangular, or triangular.

Similarly, the shape of the collars is not limited to a particular shape, and generally can be any that are capable of securing a spacer within the collar. Round metal pipes (e.g., conduit) may be readily accessible for use as spacers in the systems described herein, and thus, cylindrical collars are contemplated herein. However, the collars may also be shaped to accommodate the profile of a square tube, or any other polygon. The cross-section of the collar may typically be relatively constant along its axis. Alternatively, the collar cross section may be variable (e.g., conical, stepped) allowing a variety of spacer sizes to be received and secured within the collar.

In another embodiment, the height of the collar oriented toward the bottom of the cable reel roller frame (e.g., collar 106*b* as shown in FIG. 2) can extend to be substantially coplanar, or coplanar, with the bottom face of the cable reel roller frame. In such embodiments, the combined weight of the stacked cable payout devices can be distributed from the dividing plate of the first stacked cable payout device, to the collar 106*b*, and directly to the floor upon which the devices are stacked. In other aspects, a gap can be provided such that the dividing plate acts as a first point of support, and the floor may act as a supplemental support in the event of partial or complete failure of the dividing plate.

In certain embodiments, each of the first and second collars can be cylindrical having a diameter roughly equal, or slightly larger (e.g., ⅛ inch, ¼ inch, or ½ inch larger) than standard conduit outer dimensions. Collars may have a square or rectangle shape, an oval shape, or an irregular shape as suitable for any particular spacer. In certain aspects, either or both of the first or second collars may have a cylindrical shape. In certain aspects, collars may have an inner diameter or width in a range from ½ inch to 6 inches, from 1.5 to 4 inches or from 2 to 4 inches. Alternatively, either or both of the first and second collars may have a diameter of 1.5 inches, 1.75 inches, 2 inches, 2.25 inches, 2.5 inches, 2.75 inches, 3 inches, 3.25 inches, 3.5 inches, 3.75 inches, or 4 inches.

Collars contemplated herein may have any height suitable to retain a spacer in position, and prevent tipping of the spacer relative to its axis (and ultimately tipping the stacked cable reel rollers). It is contemplated herein that taller collars may have an improved ability to restrain tipping. However, it is also important that the collars do not interfere with the function of the cable reel roller during transport of the cable reel roller, loading the cable reel, and paying off the cable from the reel. For instance, collars disclosed herein may have a height in a range from 1 to 12 inches, from 2 to 6 inches, or from 3 to 4 inches.

First and second collars may have the same or different dimensions. For instance, in certain aspects the diameter of the first collar can be equal to the diameter of the second collar, to allow usage of a consistently sized spacer throughout the stackable support systems described herein. Alternatively, the first and second collar may have different dimensions to accommodate a variety of spacer sizes. Similarly, in certain aspects, the top collar can have a height in a range from about 3 to 4 inches, and the bottom collar can have a height in a range from 1 to 2 inches. Such configuration can provide a cable reel roller with a low profile while still being capable of retaining the spacer along a fixed axis due to the greater height of the top collar.

Collars 106*a,b* are shown in FIGS. 1-8 as being positioned coaxially with respect to each other, thereby allowing a first end of a spacer to be inserted within a collar of a first cable reel rollers and a second end of the spacer to be inserted within a collar of a second cable reel roller, and retain the spacer, along a common axis with each of the collars. This arrangement may be advantageous to increase the conformity of the outer surface of the spacer and the inner surface of the collars, limiting the space for movement of the spacer within the collar. Limiting the distance the spacer may travel within the collar may increase stability of the stacked cable reels, and reduce the possibility that lateral momentum can accumulate at the spacer if the stack receives a lateral force (e.g., if bumped by a forklift).

In the same manner, spacers can have a length to width ratio that advantageously increases the stability of the spacer within the collar, and distributes the weight of applied to the dividing plate sufficiently to prevent puncture of the dividing plate. In certain aspects, the spacers may have a length in a range from about 3 inches to about 2 feet, from about 1 to about 6 inches, from about 2 inches to about 12 inches, or from about 4 to about 18 inches. Spacers may also have a width or diameter in a range from about 1.5 to about 4 inches, and generally similar to common conduit sizes. Thus, in certain embodiments, spacers contemplated herein can comprise a length to width ratio of less than about 10:1, less than about 5:1, less than about 4:1, less than about 3:1, or less than about 2:1.

Spacers contemplated herein may be segments of conduit, and are not limited to any particular material. Generally spacers of the present disclosure may comprise any material suitable to withstand the stacking forces applied. In certain aspects, the spacers can be a segment of conduit, such as a galvanized steel conduit, a stainless steel conduit, or an aluminum conduit. Thus, in certain aspects, spacers may have a width or diameter of about 1.5 inches, about 2 inches, about 2.5 inches, about 3 inches, or about 4 inches. The spacer may also be defined by a width or diameter relative to an inner dimension of the collar. For instance in certain aspects the width or diameter of the spacer can be less than an inner width or diameter of the collar by about ⅛ inch, about ¼ inch, about ½ inch, about ¾ inch, about 1 inch, or about 1.5 inches. Alternatively, the width or diameter of the spacer can be less than an inner width or diameter of the collar from about ⅛ inch to about 1 inch. Generally, a smaller distance between the outer dimension of the spacer and the inner dimension of the collar leads to increased stability and reduced chance for tipping forces to accumulate.

Other arrangements of the first and second collars are contemplated herein. In certain aspects, the first and second collar can have a common plane of symmetry that passes through the dividing plate. In other aspects, the first and second collar may be defined with a spacer receiving axis, the spacer receiving axis being perpendicular to the dividing plate. In such aspects, the spacer receiving axes can be substantially vertical, and accordingly, the dividing plate may be substantially horizontal.

It is also considered and disclosed herein that a width or diameter of collars disclosed herein may be adjustable by the inclusion of an adjustment mechanism such as shown in FIGS. 1, 4-8. In certain aspects the adjustment mechanism can comprise an adjustment bolt on the exterior face of the collar and extending through the collar to connect to an adjustment saddle within the collar. As will be understood by those of ordinary skill in the art, adjustment bolts 114*a,b* independently can be advanced or retracted which in turn adjusts the lateral position of an adjustment saddle 112 within the collar. Such advancement and retraction of the adjustment bolt thus can vary the inner diameter or width of collars disclosed herein. In certain aspects, the diameter can vary between 1.5 and 4 inches, by operation of the adjustment mechanism. The adjustable saddle may have any shape suitable to be advanced within the collar, and may generally carry a shape and dimensions of a portion of the inner wall of the collar, so as to provide the same effect. For instance, in embodiments where the collar has a cylindrical shape, the saddle portion of the adjustable pipe saddle can take a crescent shape having a height equal to, or about 0.5, 1, 1.5, 2, or 3 inches less than, the height of the collar. The adjustment saddle may also seat within a cavity of the collar wall, so as to provide a continuous surface between the collar and the saddle at the collar's greatest dimension. Such arrangements provide improved strength and stability to the collar at any width within the range.

Figure 10:
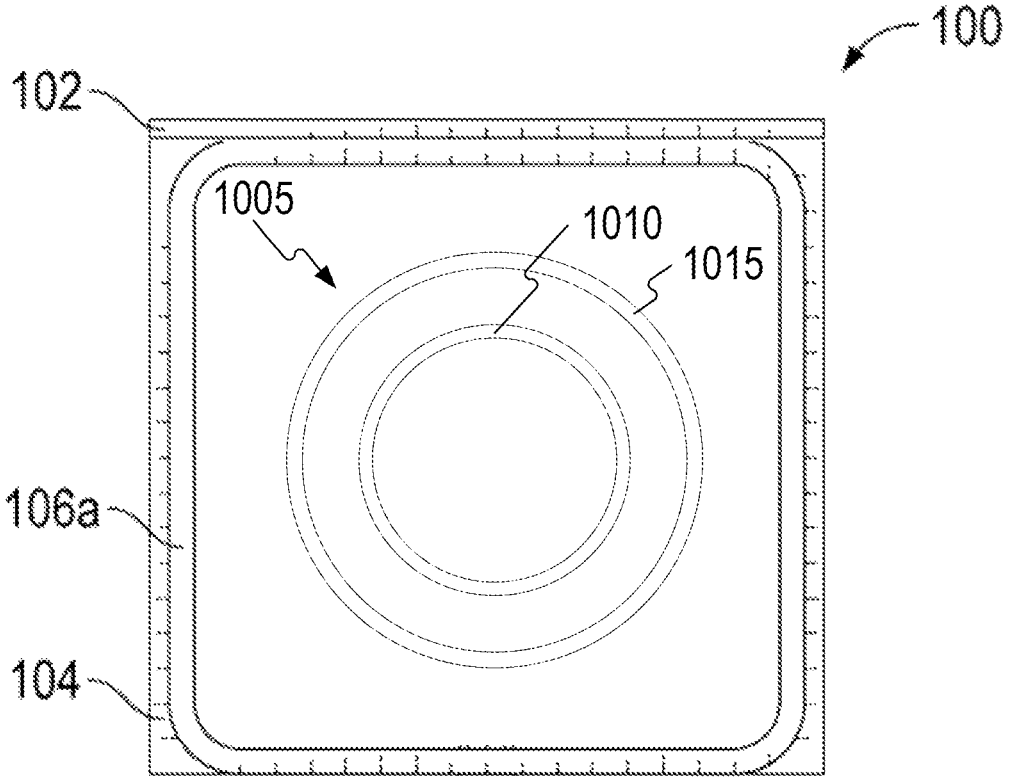
FIG. 10 depicts retaining ridges.

In alternative embodiments, differently sized spacers may be accommodated and secured within the collars by the addition of concentric retaining ridges (e.g., a first retaining ridge 1005 and a second retaining ridge 1010) within the collars, for example on the dividing plate as shown in FIG. 10. In such aspect, the retaining ridges may serve as a primary restraint to spacers having a width or outer diameter somewhat less than the inner dimension of the collar within which the spacer is seated. Thus, as a non-limiting example, the retaining ridge (e.g., first retaining ridge 1005 or second retaining ridge 1010) may have an inner width or diameter less than that of the collar (e.g., 1.5 inches), and extend from the dividing plate a height less than the height of the collar (e.g., 1 inch, 1.5 inches, 2 inches, 3 inches). In certain aspects, a plurality of retaining ridges 1015 (e.g., comprising first retaining ridge 1005 and second retaining ridge 1010) may be present in representation of common conduit sizes (e.g., 1.5, 2, 2.5, and 3 inches), across any range of collar width or diameter disclosed herein. In this manner, the collar may be suited to accommodate and receive a spacer within a range of diameters without adjustment of any collar dimension. Thus, when a 1.5 inch diameter spacer is inserted within a 4 inch diameter collar, a retaining ridge may provide support from lateral motion of the conduit, with the inner wall of the collar providing additional and secondary support should the retaining ridge fail or the spacer become unseated from the retaining ridge. Where a plurality of retaining ridges are present, the retaining ridges may be concentric, or each arranged near a collar wall and overlapping such that each retaining ridge extends from a common point, and allowing spacers of any size to be inserted in a common manner.

As shown in FIGS. 2-3, stackable systems are also disclosed herein, and supports disclosed above are generally applicable to cable payout systems, and thus not particularly limited to any specific cable payout system or cable reel roller. The stackable systems disclosed herein generally may include any cable reel roller suited to retain a cable reel on two rollers during payout of the cable. The example cable reel roller depicted in FIGS. 2-3 shows how the frame of a conventional cable reel roller can accommodate the support and spacers disclosed herein for efficient stacking. In certain aspects, the supports disclosed herein may be welded to conventional cable reel rollers to impart stacking ability on otherwise unstackable rollers. Thus, it is shown the stackable cable reel roller may comprise a plurality of rollers to support the cable reel, a motor electrically connected to at least one of the rollers to drive the motor and assist payout of the cable, fork lift receiving channels for transporting the cable reel. Alternative cable payout systems are also contemplated herein as being converted to stackable units by the addition of supports to the frame.

Stackable cable reel rollers disclosed herein can typically have four supports, one positioned at each corner of the frame. However, alternative aspects are also contemplated herein as having from two supports, three supports, or more than four supports, depending on the shape and layout of the cable reel roller frame. For instance, in certain aspects, the cable reel roller frame can have a rectangular shape and comprises a support positioned at each corner of the frame.

In certain aspects, back plate 102 can be coplanar with a surface of a portion of the frame of a cable reel roller as described herein. Indeed, the dividing plate and collars may be welded directly to the frame of a cable payout device such that a portion of the frame constitutes the back plate of the support. Methods of stacking a plurality of cable reel rollers as described herein are also contemplated within this disclosure, and can comprise positioning a first portion of each of a plurality of spacers within one of a plurality of spacer supports of a first cable reel roller, and coupling a second portion of each of the plurality of spacers within one of a plurality of spacer supports of a second cable reel roller. Generally, the first and second cable reel roller each can be any stackable cable reel roller described herein.

Positioning a first portion of the spacer within a spacer support can be accomplished by any means appropriate to secure the spacer within the collar of a support. For instance, the spacer can be manually inserted within the collar to allow the spacer to contact the dividing plate. In aspects comprising an adjustable mechanism as described above, positioning the spacer can further comprise tightening an adjustment bolt, nut, and or saddle to secure the spacer against an inner dimension of the collar. Alternatively, positioning the spacer can comprise securing the end of the spacer at least partially around an appropriately sized retaining ridge. As will be apparent to those of skill in the art, the spacer can be partially inserted within the collar, leaving a second portion of the spacer exposed for coupling with a second spacer support.

In certain aspects, coupling a second portion of each of the plurality of spacers can comprise lifting the second stackable cable reel roller, positioning the second stackable cable reel roller vertically above the first stackable reel roller; aligning the second portion of each of the plurality of spacers with an opening of a corresponding spacer collar on the second stackable cable reel roller, and lowering the second stackable cable reel roller until each of the spacers contacts the dividing plate of a spacer support of the second stackable cable reel roller. In certain aspects, the lifting can be conducted with a forklift, by inserting the forks within fork receiving channels in the cable reel roller frame. In this manner, the weight of the stacked cable reel roller can be transferred from the forks of a lift to the spacers seated within the spacer supports, and ultimately to the dividing plates of the supports.

Any number of cable reel rollers may be stacked by this method, and generally an amount capable of being supported by the combined dividing plates of the cable reel roller on the bottom of the stack. In certain aspects the methods disclosed herein can thus comprise stacking 2, or 3, or 4 or more cable reel rollers. In certain aspects, the cable reel rollers may be identical, or different. Methods disclosed herein can further comprise inserting a pin through a portion of both the collar and spacer to secure the position of the spacer and collar once stacked. Where present, such pins can be inserted through aligned holes in the collar and spacer, and provide additional stability to the stacked cable reel rollers. Pins and associated release mechanisms will be readily understood by those of ordinary skill in the art.

Alternative embodiments, examples, and modifications which would still be encompassed by the disclosure may be made by those skilled in the art, particularly in light of the foregoing teachings. Further, it should be understood that the terminology used to describe the disclosure is intended to be in the nature of words of description rather than of limitation.

Those skilled in the art will also appreciate that various adaptations and modifications of the preferred and alternative embodiments described above can be configured without departing from the scope and spirit of the disclosure. Therefore, it is to be understood that, within the scope of the embodiments described herein, the disclosure may be practiced other than as specifically described herein.

What is claimed is:

1. A stackable cable reel roller comprising:
a frame;
a plurality of rollers supported by the frame; and
a plurality of supports, each support comprising:
a dividing plate secured to the frame;
a first collar attached to a first side of the dividing plate;
a second collar attached to a second side of the dividing plate; and
wherein each of the first collar and the second collar comprises a collar adjustment mechanism configured to adjust an inner dimension of the respective first collar and second collar.

2. The stackable cable reel roller of claim 1, further comprising a back plate between the support and the frame.

3. The stackable cable reel roller of claim 2, wherein the back plate, the dividing plate, the first collar, the second collar, or any combination thereof, comprises steel having a thickness in a range from about ⅛" to about 1".

4. The stackable cable reel roller of claim 1, wherein each of the plurality of supports is welded to the frame.

5. The stackable cable reel roller of claim 1, wherein the plurality of supports comprises from 2 to 4 supports.

6. The stackable cable reel roller of claim 1, wherein the frame has a rectangular shape, and comprises a support positioned at each corner of the frame.

7. The stackable cable reel roller of claim 1, wherein the first and second collar have a cylindrical shape.

8. The stackable cable reel roller of claim 1, wherein the first collar, the second collar, or both, has:
a diameter in a range from about 1.5 to about 4 inches; and
a height of in a range from about 3 to about 12 inches.

9. The stackable cable reel roller of claim 1, wherein the collar adjustment mechanism is configured to adjust the inner dimension within a range from about 1.5 to 4 inches.

10. The stackable cable reel roller of claim 1, wherein the dividing plate comprises a retaining ridge corresponding to one of an outer dimension of a spacer and an inner dimension of a spacer.

11. The stackable cable reel roller of claim 1, wherein the dividing plate comprises a plurality of concentric retaining ridges.

12. The stackable cable reel roller of claim 1, further comprising a motor electrically connected to power at least one of the plurality of rollers.

13. A stackable cable reel roller comprising:
a frame;
a plurality of rollers supported by the frame; and
a plurality of supports, each support comprising:
a dividing plate secured to the frame wherein the dividing plate comprises a retaining ridge corresponding to one of an outer dimension of a spacer and an inner dimension of a spacer;
a first collar attached to a first side of the dividing plate; and
a second collar attached to a second side of the dividing plate.

14. The stackable cable reel roller of claim 13, further comprising a back plate between the support and the frame.

15. The stackable cable reel roller of claim 14, wherein the back plate, the dividing plate, the first collar, the second collar, or any combination thereof, comprises steel having a thickness in a range from about ⅛" to about 1".

16. The stackable cable reel roller of claim 13, wherein the frame has a rectangular shape, and comprises a support positioned at each corner of the frame.

17. The stackable cable reel roller of claim 13, wherein the first and second collar have a cylindrical shape.

18. The stackable cable reel roller of claim 13, wherein the first collar, the second collar, or both, has:
a diameter in a range from about 1.5 to about 4 inches; and
a height of in a range from about 3 to about 12 inches.

19. The stackable cable reel roller of claim 13, wherein each of the first collar and the second collar comprises a collar adjustment mechanism configured to adjust an inner dimension of the respective first collar and second collar within a range from about 1.5 to 4 inches.

20. The stackable cable reel roller of claim 13, wherein the dividing plate comprises a plurality of concentric retaining ridges.

* * * * *